US011365046B2

(12) United States Patent
Nickel

(10) Patent No.: US 11,365,046 B2
(45) Date of Patent: Jun. 21, 2022

(54) CAPSULE CONTAINING BEVERAGE POWDER, IN PARTICULAR FOR PREPARING BREWED COFFEE

(71) Applicant: Swiss Coffee Innovation AG, Olten (CH)

(72) Inventor: Axel Nickel, Hemmingen (DE)

(73) Assignee: Swiss Coffee Innovation AG, Olten (CH)

( * ) Notice: Subject to any disclaimer, the term of this patent is extended or adjusted under 35 U.S.C. 154(b) by 0 days.

(21) Appl. No.: 16/090,574

(22) PCT Filed: Mar. 22, 2017

(86) PCT No.: PCT/EP2017/056875

§ 371 (c)(1),
(2) Date: Oct. 1, 2018

(87) PCT Pub. No.: WO2017/167624

PCT Pub. Date: Oct. 5, 2017

(65) Prior Publication Data

US 2019/0144199 A1 May 16, 2019

(30) Foreign Application Priority Data

Mar. 31, 2016 (EP) ..... 16163122

(51) Int. Cl.
*B65D 65/46* (2006.01)
*B65D 85/804* (2006.01)

(52) U.S. Cl.
CPC ..... *B65D 85/8046* (2013.01); *B65D 65/466* (2013.01)

(58) Field of Classification Search
CPC ..... B65D 85/8043; B65D 85/804; B65D 85/8046; B65D 65/466
See application file for complete search history.

(56) References Cited

U.S. PATENT DOCUMENTS 4,143,007 A * 3/1979 DeMartino ..... C08L 5/14 507/201
4,226,264 A * 10/1980 Bridgeford ..... A22C 13/0013 138/118.1

(Continued)

FOREIGN PATENT DOCUMENTS

CN 101918049 A 12/2010
CN 1795229 B 2/2012

(Continued)

OTHER PUBLICATIONS

Formal Human Translation of Kim KR 20140112339. Published Sep. 2014. (Year: 2014).*

(Continued)

*Primary Examiner* — Ericson M Lachica
(74) *Attorney, Agent, or Firm* — Hershkovitz & Associates, PLLC; Abraham Hershkovitz; Eugene C. Rzucidlo

(57) ABSTRACT

The invention relates to a capsule, in particular for preparing a beverage from beverage powder, in particular coffee from coffee powder (1), by introducing water into the capsule, which capsule comprises a capsule body (2), which is composed of at least one polysaccharide and which is filled with a powder containing polysaccharide, wherein the capsule body (2) is encased by at least one coating layer (3), wherein the at least one coating layer (3) comprises a cross-linked polysaccharide, wherein the cross-linked polysaccharide was obtained by cross-linking a polysaccharide by means of a cross-linking agent. A method for producing such a capsule comprises the following steps: i) providing a capsule body (2) composed of at least one polysaccharide, ii) filling the capsule body (2) with a powder composed of polysaccharide, iii) wetting at least part of and preferably the entire surface of the capsule body (2) obtained in step ii) with a solution of a polysaccharide in a solvent or with a (Continued)

Figure 1A:
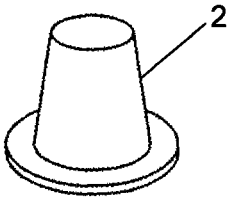

dispersion of a polysaccharide in a dispersant, iv) bringing the capsule body (2) obtained in step iii) in contact with at least one cross-linking agent, and v) drying the capsule body (2) obtained in step iv).

12 Claims, 1 Drawing Sheet

(56) References Cited

U.S. PATENT DOCUMENTS

| | | | | |
|---|---|---|---|---|
| 5,688,776 | A * | 11/1997 | Bauer | A61K 9/1652 514/54 |
| 9,526,370 | B2 | 12/2016 | Suggi Liverani et al. | |
| 2002/0110593 | A1* | 8/2002 | Penhasi | A61K 9/209 424/480 |
| 2005/0202229 | A1* | 9/2005 | Ozasa | B29C 43/206 428/304.4 |
| 2006/0280713 | A1 | 12/2006 | Malessa | |
| 2008/0149561 | A1* | 6/2008 | Chu | B01D 69/10 210/500.38 |
| 2010/0323083 | A1 | 12/2010 | Rubinstenn et al. | |
| 2011/0097367 | A1 | 4/2011 | Wallrapp et al. | |
| 2012/0125231 | A1* | 5/2012 | Markland | C09D 103/08 106/145.1 |
| 2013/0129872 | A1* | 5/2013 | Kruger | B65D 85/8043 426/115 |
| 2013/0259983 | A1 | 10/2013 | Vanni et al. | |
| 2014/0034864 | A1 | 2/2014 | Kern et al. | |
| 2014/0034865 | A1 | 2/2014 | Woehrle et al. | |
| 2014/0193653 | A1* | 7/2014 | Combs | B32B 27/12 428/535 |
| 2017/0158422 | A1 | 6/2017 | Andreae et al. | |

FOREIGN PATENT DOCUMENTS

| | | | | |
|---|---|---|---|---|
| CN | 103402586 | A | 11/2013 | |
| CN | 103458976 | B | 11/2015 | |
| EP | 2648579 | A1 | 10/2013 | |
| KR | 20140112339 | A * | 9/2014 | |
| KR | 20140112339 | A | 9/2014 | |
| WO | 2009/053811 | A2 | 4/2009 | |
| WO | 2010/006979 | A1 | 1/2010 | |
| WO | 2014/161653 | A1 | 10/2014 | |
| WO | 2015/177591 | A2 | 11/2015 | |
| WO | WO-2016079701 | A * | 5/2016 | B65D 77/24 |

OTHER PUBLICATIONS

Blamire, John. "polysaccharides." 2004. <http://www.brooklyn.cuny.edu/bc/ahp/LAD/C4c/C4c_polysaccharides.html>. Accessed Oct. 29, 2020. (Year: 2004).*

English language Abstract of KR 20140112339 A (Sep. 23, 2014).

Office Action in related Chinese Application No. 201680048709.6, dated Jul. 3, 2019.

English language International Preliminary Report on Patentability (IPRP) dated Oct. 11, 2018 under Chapter I, transmitting an English language translation of the Written Opinion of the International Search Authority (ISA) dated May 15, 2017 in PCT Application No. PCT/EP2017/050117 filed Mar. 22, 2017.

English language translation of the International Search Report (ISR) dated May 15, 2017 in PCT Application No. PCT/EP2017/050117 filed Mar. 22, 2017.

English Abstract of WO 2010/006979.

* cited by examiner

CAPSULE CONTAINING BEVERAGE POWDER, IN PARTICULAR FOR PREPARING BREWED COFFEE

The present invention relates to a capsule containing beverage powder, which is particularly suitable for preparing a beverage such as cocoa, tea or coffee.

In the last couple of years, along with coffee pads coffee capsules have been used increasingly for the preparation of beverages in portions, in particular for preparing brewed coffee, which capsules comprised walls typically made of stainless steel, aluminium or plastic material. Such capsules allow the storing of coffee powder over a longer time without a significant aroma loss. In addition, such capsules enable the fast and user-friendly preparation of a portion of coffee in a desired coffee flavour, in that a capsule with the desired type of coffee is inserted in an appropriately adapted coffee machine, in which hot water is pressed through the capsule and thus, brewed coffee is prepared. However, such capsules are comparably expensive, among other things because of the applied capsule materials as well as the capsule construction that has a complex production process. In addition, such capsules are environmentally problematic. On the one hand, the capsules are not recyclable and are regularly discarded by the consumer as residual waste after the use. Therefore, there is practically no recycling of coffee capsules, which is particularly critical for coffee capsules on aluminium basis, as the aluminium production is very energy-intensive, which is why such capsules cause a particularly bad CO2 footprint. Another huge disadvantage is that such capsules are not bio-degradable and thus cannot be discarded biologically. In view of the fact that in Germany alone, far more than 3 billion coffee capsules are used per year, this is a serious problem.

In order to circumvent the problems described above at least partially, there have already been proposals for capsules made of alternative materials.

In WO 2010/006979, for instance, capsules are provided which are filled on the inside with coffee or tea and comprise a capsule wall, which—along with the capsule content—contains water as structuring component. However, in order to obtain a stable capsule wall, it is necessary to cool the capsules down below the freezing point of the structuring component, because the structuring component melts if its freezing point is exceeded, and thus wets the capsule content. Naturally, this significantly restricts the use of such capsules.

In WO 2009/053811 A2, a capsule is described which can contain ground coffee, cappuccino powder, chocolate powder, milk powder or tea powder. The capsule consists of two half shells forming capsule walls. The capsule walls consist of a water-soluble material that dissolves in the brewing operation. In this concept, the capsule wall material is dissolved during the brewing operation and thus becomes a part of the prepared beverage, which might have an undesired impact on the taste thereof.

Based thereon, the present invention has the objective to provide a capsule for preparing a beverage of beverage powder in portions, such as chocolate, tea or coffee, which is not only easily and cost-efficiently producible, but which is in particular biodegradable and can thus be discarded in an environmentally friendly way, is suitable for storing the capsule content also over a longer period without significant aroma loss, and which can be used with different beverage machines, depending on the design.

According to the invention, this objective is solved by providing a capsule, in particular for preparing a beverage from beverage powder, in particular coffee from coffee powder, by inserting water into the capsule, comprising a capsule body consisting of at least one polysaccharide, which is filled with a powder containing polysaccharide, wherein the capsule body is encased by at least one coating layer, wherein the at least one coating layer comprises a cross-linked polysaccharide, wherein the cross-linked polysaccharide was obtained by cross-linking one polysaccharide with a cross-linking agent.

This solution is based on the cognition that such a capsule comprising a capsule body composed of at least one polysaccharide, which is encased by at least one coating layer made of cross-linked polysaccharide, does not only comprise all necessary properties that are required in order to use such capsule for the preparation of beverages, such as coffee, in portions, but is particularly also environmentally friendly disposable. With the at least one coating layer made of one cross-linked polysaccharide is in particular stable enough to provide sufficient transport safety and touch protection. In addition, the capsule can endure even high pressures, as those that might occur during the preparation of a brewed beverage.

Apart from that, the capsule according to the invention protects the capsule content because of the at least one coating layer made of a cross-linked polysaccharide also over a longer time without risking a significant aroma loss. This is due to the fact that the coating layer seals the surface of the usually air-permeable capsule body made of polysaccharide. In addition, the coating layer of cross-linked polysaccharide acts as additional oxygen barrier. The combination of the capsule body and the coating layer of cross-linked polysaccharide thus ensures a conservation of the aroma of the capsule content. Another advantage of the capsule according to the invention is that neither the capsule body nor the at least one coating layer dissolve during the preparation of the beverage and thus no distortion of the taste of the prepared beverage occurs. Apart from that, the capsule according to the invention can be produced easily and cost-effectively. Another crucial advantage is that both the capsule body and the at least one coating layer made of cross-linked polysaccharide are fully biodegradable and can thus be discarded in an environmentally friendly way. As polysaccharides are not of fossil origin and not of synthetic origin, the generation of such polysaccharides requires comparably little energy and thus the capsule according to the invention has an advantageous $CO_2$ footprint.

Principally, the present invention is not limited regarding the chemical nature of the polysaccharide of the at least one coating layer. Good results are particularly obtained, if the polysaccharide of the at least one coating layer is selected from the group of substances consisting of starch, cellulose, chitin, carrageen, agar and alginates. Particularly preferred is a polysaccharide of the at least one coating layer of a carrageen or an alginate, whereby it is very particularly preferred that the polysaccharide of the at least one coating layer is an alginate. Within the framework of the present invention it was found out that these polysaccharides do not cause any distortion of the taste during the preparation of the beverage. It moreover appeared within the framework of the present invention that capsule bodies of polysaccharide with alginate can be easily and cost-efficiently coated. Alginates are thereby biodegradable and provide a sufficiently stable casing and protect the capsule content without a significant aroma loss. Within the framework of the present invention it furthermore appeared that alginates are suitable for reducing the water hardness. This also helps preventing or at least mitigating an unpleasant acid taste.

It is essential to the invention that the polysaccharide of the at least one coating layer is cross-linked. The cross-linking of the polysaccharide may also be achieved through covalent bonds according to one embodiment of the present invention. A cross-linking through covalent bonds makes very sustainable coatings possible. In that, the cross-linking through covalent bonds is usually taking place by the reaction of the polysaccharide with a suitable cross-linking agent. Particularly difunctional organic compounds are suitable as cross-linking agents, whereby the functional groups are selected from a group, for instance, which includes carboxylic acids, salts of carboxylic acids, activated carboxylic acids, amines, alcohols, aldehydes and ketones. Activated carboxylic acids in this context are carboxylic acid halides, active esters of carboxylic acids, anhydrides of carboxylic acids or other reactive derivatives of carboxylic acids.

The cross-linking can thereby take place without the use of a spacer, in particular without the use of a polyol spacer.

However, the cross-linking can also be carried out with a spacer and in particular a polyol spacer. The polyol spacer is preferable an aliphatic, cyclic or aromatic polyol and particularly preferred an ethylene glycol, propanetriol, triethylene glycol, polyethylene glycol, sorbitol, glucose, fructose, galactose, cyanidin, corilagin, digallic acid, gallic acid or tannic acid. With the polyol spacer, a specific elasticity of the coating layer is achieved, and the water uptake and the vapor permeability can be specifically impacted.

According to an alternative and particularly preferred embodiment of the present invention, the polysaccharide of the at least one coating layer is cross-linked through ionic and/or coordinative bonds. Such polysaccharides cross-linked through ionic and/or coordinative bonds can be particularly easily produced and do not impair the biodegradability of the used polysaccharide. The ionic and/or coordinative cross-linking can be reached through polysaccharides, for instance, which contain anionic groups, such as carboxylate groups or sulfonate groups. By inserting bivalent or higher valent cations, in particular alkaline earth metal ions, an ionic or coordinative cross-linking of the anionic groups of the polysaccharides is taking place in order to form a stable encasing layer.

A coordinative bond in this context refers to an interaction between an electron-pair donor and an electron-pair acceptor, as might occur, for instance, between free electron pairs of oxygen atoms in hydroxy groups and cations.

Very particularly preferred, the cross-linked polysaccharide is an alkaline earth metal alginate, and most preferred a calcium alginate. In this case, the calcium ions are the cross-linking agents, as they form coordinative or ionic bonds with groups of the alginate. Within the framework of the present invention, it was surprisingly found out that a coating comprising calcium alginate provides a water-insoluble layer that does not impair the taste of the beverage prepared by using the capsules and provides sufficient stability of the capsule in order to ensure transport safety and touch protection without a significant aroma loss for the capsule content. In addition, calcium alginate has outstanding biodegradable properties. Another advantage is that calcium alginate is an approved food additive with E number E405 and is thus not harmful for the health.

For further developing the idea underlying the invention, it is suggested that the coating layer comprises fibres in order to increase the mechanical stability of the coating layer. These fibres may be polysaccharide fibres, as these are biodegradable, whereby good results are reached in particular with cellulose fibres such as cotton fibres. The fibres are preferably long fibres, namely preferably such with a length of at least 100 μm, preferably at least 1 mm, and particularly preferably at least 5 mm. These long fibres are suitable to absorb high tensile forces in the layer.

As an alternative to fibres, or even in addition to fibres, the at least one coating layer may also comprise yarns or tissues made of such fibres.

Principally, the capsule according to the invention can only comprise one coating layer made of cross-linked polysaccharide. In order to increase the stability of the capsules and thus the transport safety and touch protection, it is suggested for further developing the idea underlying the invention that the capsule according to the invention comprises two or more coating layers. Preferably, the capsule body is encased by 2 to 100 coating layers, particularly preferably with 2 to 20 coating layers, very particularly preferably with 2 to 10 coating layers, and most preferably with 2 to 5 coating layers. By coating the capsule body of the capsules with two or more coating layers, the effect of the coating as oxygen barrier as well as the associated provision of an effective aroma protection is reached to a particularly high extent.

According to another particularly preferred embodiment of the present invention, the coating of the capsule body consists of 2 to 100, preferably 2 to 20, particularly preferably 2 to 10, and most preferably 2 to 5 calcium alginate layers, which optionally contain cellulose fibres.

Depending on the viscosity of the sodium alginate solution and the applied process, the individual coating layers comprise thicknesses of 40 to 600 μm. Particularly preferred are layer thicknesses of 70 to 350 μm for the first coating layer, as they incorporate the optimal comprise between stability and drying speed. The subsequent layers are preferably thinner and are preferably between 40 and 200 μm in order to make a quick drying possible.

Consequently, a thin coating layer is preferred in order to remove the water contained in the gel more easily, and in order to facilitate a fast diffusing of the cross-linking agent, i.e. the calcium ions, into the sodium alginate. Principally, the speed of the diffusion of calcium ions into the sodium alginate could also be increased by means of a higher concentration of the cross-linking agent; however, in the practical implementation of this variant thin coating layers proved advantageous for the speed of the diffusion and for the handling.

It is principally possible to coat the capsule body of the capsule according to the invention only partially with the at least one coating layer. However, it is preferred that the capsule body is fully encased by the at least one coating layer.

Regarding the material, with which the capsule body of the capsules according to the invention is filled, the present invention is not specifically limited. Good results are achieved in particular, if the capsule body is filled with a material that is selected from the group consisting of coffee, tea, drinking chocolate, cocoa and milk powder. Good results are particularly achieved if the capsule body is filled with ground coffee powder.

The material with which the capsule body of the capsule according to the invention is filled, may be compressed powder or uncompressed powder, i.e. a pellet.

The present invention is also not particularly limited concerning the form of the capsule body. The capsule body may particularly have any shape that is compatible with the existing capsule beverage machines, such as the commercially available capsule coffee machines. Good results are achieved in particular if the capsule body has the shape of a hollow cylinder, a hollow cylinder having a collar at its front side, a hollow truncated cone, a hollow truncated cone having a collar at its front side, or of a cube that is hollow inside. The hollow cylinder and the hollow truncated cone may be closed on all sides, i.e. on the front side as well, or open on one or both frond sides, so that only the shell surfaces are closed. As an alternative, it is also possible that the open front sides of the hollow cylinder and of the hollow truncated cone are closed with a membrane or a polysaccharide that differs from that of the shell surface of the hollow cylinder or the hollow truncated cone, respectively. The polysaccharide may particularly be more easily perforated at the two front sides than the polysaccharide of the shell surface of the hollow cylinder or the hollow truncated cone, which can be achieved, for instance, by applying thinner paperboard or thinner paper on the front sides of the hollow cylinder or the hollow truncated cone, respectively, than at the shell surface of the hollow cylinder or hollow truncated cone, and/or by applying less rigid paperboard or less rigid paper at the front sides of the hollow cylinder or the hollow truncated cone, respectively, than at the shell surface of the hollow cylinder or hollow truncated cone.

For further developing the idea underlying the invention it is suggested to provide a capsule body composed of a fibrous polysaccharide in order to give the capsule body the appropriate mechanical stability. The fibrous polysaccharide can particularly be fibre material made of starch, cellulose, chitin, carrageen, agar and alginate. Particularly preferred is fibre material made of cellulose fibres, as they stand out with high availability due to low prices and with high strengths. Particularly preferred fibre materials of which the capsule body can be composed, are paper, paperboard and cardboard. Preferably, the thickness of the capsule body is 0.1 to 10 mm, preferably 0.25 to 2.5 mm, and particularly preferably 0.5 to 1.5 mm.

Another subject matter of the present invention is a capsule comprising a capsule body made of paper, paperboard or cardboard, which is filled with a powder of a substance selected from a group consisting of coffee, tea, drinking chocolate, cocoa and milk powder, whereby the capsule body is coated with 1 to 100, preferably with 2 to 20, particularly preferably with 2 to 10, and most preferably with 2 to 5 coating layers of calcium alginate that optionally contain cellulose fibres, such as cotton fibres.

Another subject matter of the present invention is a method for producing a capsule comprising the following steps:

i) Providing a capsule body composed of at least one polysaccharide,
ii) filling the capsule body with a powder composed of polysaccharide,
iii) wetting at least part of and preferably the entire surface of the capsule body obtained in step ii) with a solution of a polysaccharide in a solvent or with a dispersion of a polysaccharide in a dispersant,
iv) bringing the capsule body obtained in step iii) in contact with at least one cross-linking agent, and
v) drying the capsule body obtained in step iv).

Wetting the capsule body in step iii) is preferably carried out in such a manner that at least a part of the surface and preferably the entire surface of the capsule body is wetted with the solution or the dispersion of the polysaccharide. The wetting or bringing in contact of the capsule body according to steps iii) and iv) can take place independent from one another, for instance, by immersing, spraying or coating the capsule body with the solution or the dispersion of the polysaccharide or with the cross-linking agent, respectively.

The method according to the invention makes it possible to encase the capsule body evenly, in particular also if the capsule body has a collar at its front side, for instance, without the formation of an edge or a joint.

The solvent or dispersant is preferably a water-based solvent or dispersant. Particularly preferably the solvent or dispersant is water.

In step iii) the capsule body is preferably wetted with an aqueous 0.5 to 5 percent by weight alkaline metal alginate solution. Particularly preferably, in step iii) the capsule body is wetted with an aqueous 1 to 2 percent by weight alkaline metal alginate solution. With a concentration of less than 0.5 percent by weight, the alkaline metal alginate solution is not sufficiently concentrated and too low-viscous to apply a sufficient amount of alkaline metal alginate onto the capsule body in a simple wetting process in order to produce a sufficiently stable encasing in the subsequent steps. If the concentration of the alkaline metal alginate exceeds 5 percent by weight, the viscosity of the alkaline metal alginate solution is so high that the formation of a complete encasing is made more difficult. In addition, the coating thicknesses increase at a concentration of the alkaline metal alginate of more than 5 percent by weight, which turns drying more difficult. In addition, the coating thicknesses get too high to be dried in an economically sustainable way.

The alkaline metal alginate solution is preferably a solution of a salt that consists of alginate and a cation of an alkaline metal or a related cation, for instance an ammonium ion. Particularly preferably, the alkaline metal alginate solution is an aqueous solution of sodium alginate, potassium alginate or ammonium alginate. Sodium alginate, potassium alginate and ammonium alginate are approved food additives with the E numbers E401, E402 or E403, respectively. Such coatings can be used for food products without reservations. Very particularly preferably, it is an aqueous solution of sodium alginate.

In the method according to the present invention it is preferred that the capsule body is brought in contact with an aqueous 1 to 15 percent by weight, preferably a 1 to 7 percent by weight alkaline earth metal salt solution in step iv). With an alkaline earth metal salt concentration of 1 to 15 percent by weight and preferably of 1 to 7 percent by weight a fast ionic cross-linking of the polysaccharide can be achieved. The alkaline earth metal salt is preferably a calcium salt, such as calcium chloride in particular.

In order to coat a capsule body with several coating layers, the steps ii) to iv) or ii) to v) can be repeated several times, namely preferably 2 to 10 times, particularly preferably 2 to 10 times and most preferably 2 to 5 times.

The drying foreseen in step v) can take place in different ways, whereby various drying methods have proved effective. A very uniform drying process can be achieved in particular, but not exclusively, by drying in the air stream of suitable channels, whereby the capsule body is free-floating and dries uniformly in its own rotation. In order to better absorb the water diffusing out of the forming coating layer, a contact drying at absorbing or warm surfaces also proved effective. Both principles can be combined in some kind of floating bed channel. As alternative highly efficient drying principles infrared driers and microwave driers could be used as well.

Another subject matter of the present invention is the use of the capsule according to the invention for producing a beverage by bringing the capsule according to the invention in contact with water. Preferably, the capsule contains a material selected from the group consisting of coffee, tea, drinking chocolate, cocoa and milk powder.

The use of the capsules according to the invention for preparing a coffee beverage allows the preparation of the beverage in portions, depending on the respective demand. A specific advantage of the use according to the invention is that only biodegradable waste is produced.

When using the capsules according to the invention for preparing a beverage, in particular a coffee beverage, the coffee capsule is preferably squashed or perforated before the subsequent extraction of the squashed or perforated coffee capsule with water.

Hereunder, the present invention is described merely exemplary based on advantageous embodiments and with reference to the attached drafts.

Figure 1B:
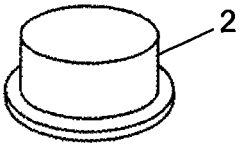
Figure 1C:
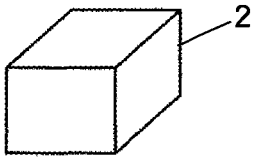
Figure 2A:
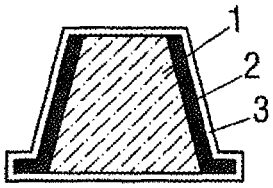
Figure 2B:
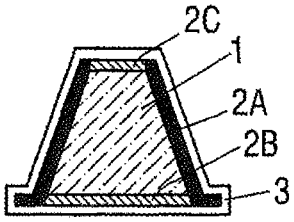
Figure 3A:
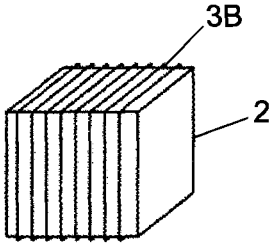
Figure 3B:
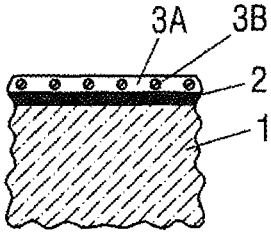

The figures thereby show the following:

FIG. 1A to 1C perspective views of a capsule body of capsules according to three embodiments of the present invention, FIGS. 2A and 2B schematic cross-sections through capsules according to two embodiment examples of the present invention, FIG. 3A a perspective view of a capsule body encased with fibres in accordance with an embodiment example of the present invention, and FIG. 3B a schematic cross-section through the upper half of a capsule according to one embodiment example of the present invention.

The capsule bodies shown in FIG. 1A to 1C have the shape of a hollow truncated cone open at both front sides with a collar at the lower front side (FIG. 1A), a hollow cylinder with a collar at its lower front side closed on all sides (FIG. 1*b*) or a cube closed on all sides with a hollow inside (FIG. 1C).

The capsule shown in a cross-section in FIG. 2A consists of a capsule body 2 filled with a coffee powder 1 comprising the hollow truncated cone shape with collar open at both front sides shown in FIG. 1A, the outside of which is fully encased with a coating layer 3 consisting of calcium alginate. Due to the two open front sides of the capsule body in the shape of a hollow truncated cone, the coffee powder 1 is encased with the capsule body 2 only at the shell surfaces of the hollow truncated cone, however, at the two front sides of the hollow truncated cone it is directly encased with the coating layer 3.

In FIG. 2B a cross-section of a capsule is illustrated which comprises the capsule body shown in FIG. 1B. As this capsule body is closed on all sides, the coffee powder 1 in this embodiment is encased by the capsule body 2 on all sides, which, in turn, is encased by the coating layer 3 on all sides. However, the two front sides 2B, 2C of the capsule body 2 are closed by a polysaccharide that can be perforated more easily than the shell surface 2A of the capsule body 2. Consequently, due to its strong shell surface, the capsule body has a high mechanical stability, however, it can easily be perforated at its front sides in a coffee machine so as to introduce water into the capsules.

FIG. 3A shows a capsule body in the shape shown in FIG. 1C that is coated in several layers of cotton fibre.

FIG. 3B finally shows the cross-section of an upper half of a capsule that was produced by provision a coating layer 3 on the capsule body shown in FIG. 3A. The coffee powder 1 is thereby encased by the capsule body 2 shown in FIG. 1 C, whereby the capsule body 2, in turn, is encased by the coating layer 3A in which the cotton fibres 3B are embedded.

The present invention is exemplified hereunder based on three examples illustrating, but not restricting the invention.

EXAMPLE 1

6.5 g of ground roasted coffee 1 were filled into a capsule body 2 made of paperboard that is shaped in accordance with the embodiment shown in FIG. 1A. The thus obtained body was coated first from one side with a 1 percent by weightage aqueous sodium alginate solution. After the one-sided coating of the body with the sodium alginate solution, this was sprayed with a 5 percent by weightage $CaCl_2$ solution. As immediately a gel layer starts to form that is not touch sensitive, the shaped body could be rotated and coated in the same way on the other side as well. Subsequently, the body was dried for two minutes in an air stream at room temperature. Immediately thereafter, another coating process has taken place, only that this time the overall shaped body was fully coated.

In this way, the coffee capsule illustrated in FIG. 2A was obtained after another drying process that took approximately 20 minutes. The capsule body 2 filled with coffee 1 was thus permanently encased with the coating 3.

At the upper side and the bottom side of the capsule the coffee powder was only encased by the coating substance in the form of a membrane. This membrane could thus be easily perforated, whereas the capsule body 2 formed a correspondingly stable protection for the brewing operation and the ejection from the coffee machine.

EXAMPLE 2

It was processed as described in example 1, with the exception that a capsule body 2 made of paperboard shaped in accordance with FIG. 2A was applied in order to obtain the coffee capsule a cross-section of which is shown in FIG. 2B.

The front sides 2B, 2C of the capsule body 2 were thereby closed by a polysaccharide that could be perforated more easily than the shell surface 2A of the capsule body 2. Because of its strong shell surface, the capsule body thus has a high mechanic stability, however, it could be easily perforated in a coffee machine at its front sides.

EXAMPLE 3

A capsule body 2 as shown in FIG. 1C was produced by folding a suitable paperboard. Thereafter, the capsule body 2 was wrapped with long fibres made of cleaned cotton in the form of a cube after being filled with coffee powder 1, as is apparent from the schematic illustration in FIG. 3A. In a next step the capsule body 2 was coated with a 2 percent by weight aqueous sodium alginate solution. Following the coating of the shaped body with the sodium alginate solution was sprayed with a 5 percent by weightage $CaCl_2$ solution.

After the approximately 20 minutes of drying, a capsule was obtained with a structure as shown in FIG. 3B. The coffee powder 1 was encased by the paperboard 2. In the coating layer of cross-linked polysaccharide 3A the long fibres of cotton 3B were embedded.

With that, a very stable structure of the capsule was achieved.

The invention claimed is:

1. A capsule, for preparing a beverage from beverage powder by introducing water into the capsule, which capsule comprises a capsule body composed of at least one polysaccharide and which is filled with a powder containing polysaccharide, wherein the capsule body is completely encased by at least one air-tight coating layer, wherein the at least one air-tight coating layer comprises a cross-linked polysaccharide, wherein the crosslinked polysaccharide is derived from chitin, a carrageen, agar or an alginate, wherein the cross-linked polysaccharide was obtained by cross-linking a polysaccharide by means of a cross-linking agent, and wherein the at least one air-tight coating layer is not dissolved during beverage preparation.

2. The capsule according to claim 1, wherein the polysaccharide of the at least one air-tight coating layer is an alginate.

3. The capsule according to claim 1, wherein the polysaccharide of the at least one air-tight coating layer is cross-linked through a covalent bond.

4. The capsule according to claim 3, wherein the polysaccharide of the at least one air-tight coating layer is cross-linked with a cross-linking agent comprising at least one of carbonyl and of carboxyl group, wherein the polysaccharide comprises a polyol spacer.

5. The capsule according to claim 1, wherein the polysaccharide of the at least one air-tight coating layer is cross-linked through at least one of ionic and of coordinative bonds.

6. The capsule according to claim 5, wherein the cross-linked polysaccharide of the at least one single air-tight coating layer is an alkaline earth metal alginate.

7. The capsule according to claim 1, wherein the at least one air-tight coating layer comprises fibres.

8. The capsule according to claim 1, wherein the capsule body is encased with 1 to 100 air-tight coating layers, whereby the air-tight coating layers are composed of calcium alginate that optionally comprises cellulose fibres.

9. The capsule according to claim 1, wherein the capsule body is filled with a material selected from a group consisting of coffee, tea, drinking chocolate, cocoa, and milk powder.

10. The capsule according to claim 1, wherein the capsule body is shaped as a hollow cylinder, a hollow cylinder having at its one front end a collar, a hollow truncated cone, a hollow truncated cone having a collar at one of its front ends, or a cube that is hollow on the inside.

11. The capsule according to claim 1, wherein the capsule body is composed of a fibrous polysaccharide, which is paper, paperboard or cardboard.

12. The capsule according to claim 1 wherein the beverage is coffee from coffee powder.

* * * * *